United States Patent [19]

Baitz et al.

[11] Patent Number: 4,642,449

[45] Date of Patent: Feb. 10, 1987

[54] CASHBOX FOR A CASH REGISTER

[75] Inventors: Guenter Baitz; Wilfried Dobring, both of Berlin, Fed. Rep. of Germany

[73] Assignee: Nixdorf Computer AG, Fed. Rep. of Germany

[21] Appl. No.: 717,375

[22] Filed: Mar. 29, 1985

[30] Foreign Application Priority Data

Mar. 29, 1984 [DE] Fed. Rep. of Germany ... 8409724[U]

[51] Int. Cl.[4] ..... G07G 1/00

[52] U.S. Cl. ..... 235/22; 235/1 R; 235/1 D; 235/7 R; 235/10

[58] Field of Search ..... 235/10, 22, 1 R, 1 D, 235/1 E, 7 R

[56] References Cited

U.S. PATENT DOCUMENTS 4,436,989 3/1984 Schuldt ..... 235/22

FOREIGN PATENT DOCUMENTS 3014545 4/1982 Fed. Rep. of Germany .

*Primary Examiner*—Benjamin R. Fuller

*Attorney, Agent, or Firm*—Krass & Young

[57] ABSTRACT

The invention relates to a cashbox for a cash register, with a money drawer mounted in a cash case so as to be slidable in a moving-in and a moving-out direction, a sliding drive for the money drawer with spring means which act on the money drawer, are stressed when the latter moves in, and supply the force for moving the money drawer when it has moved in and also a lid operationally connected with the money drawer which lid swings open when the latter is moved out and swings shut when it moves in.

18 Claims, 10 Drawing Figures

CASHBOX FOR A CASH REGISTER

TECHNICAL FIELD

The invention relates to a cashbox for a cash register, with a money drawer mounted in a cash case so as to be slidable in a moving-in and a moving-out direction, a sliding drive for the money drawer with spring means which act on the money drawer, are stressed when the latter moves in, and supply the force for moving the money drawer out, a locking mechanism for the money drawer when it has moved in and also a lid operationally connected with the money drawer which lid swings open when the latter is moved out and swings shut when it moves in.

BACKGROUND OF THE INVENTION

The money drawer generally made for receiving a separate removable insert may for example be pushed by hand into the cash case against the force of the spring means. For opening this money drawer, a bolt holding the money drawer fast in its moved-in position is moved, for example manually or electromechanically, out of a closed position, so that the money drawer can be slid out of the cash case by the force of the spring means.

Special requirements are imposed on the money drawers of such cash registers, since on the one hand they must operate reliably securely and be easy to service, and on the other hand the prescribed working space of the occupational cooperatives (e.g. cooperative banks requires for ergonomic reasons that the cash registers have very short opening paths).

For a given useful area of the money drawer, short opening paths are achieved on the one hand by comparatively wide money drawers of small depth. Another measure for reducing the opening stroke of the money drawer as compared with conventional money drawers consists in moving the money drawer out to only part of its depth and at the same time opening a covering element which unblocks the part of the money drawer which has not moved out.

A cashbox of the type of the species is already known in which both measures described are put into practice (German Pat. No. 3,014,545). The width of the money drawer is considerably greater than its depth; when the money drawer is moved out, by means of an operative connection between the money drawer and a lid the latter is opened, so that it makes accessible the rear part of the money drawer, which is still located inside the cash case.

The sliding drive for the money drawer consists substantially of racks arranged in the cash case on which pinions roll along which are pivoted on the money drawer, where the pinions are loaded in a rotation direction corresponding to the moving-out direction of the money drawer by coil springs. These kind of coil springs are comparatively expensive components as regards both their manufacture and their assembly, especially when, as in the case of the German Patent mentioned, the pinions must undergo a number of rotations for the whole moving-out path.

In addition to a sliding lid construction, which is very expensive by reason of the support and guide problems it involves, German Pat. No. 3,014,545 also shows a solution with a hinged lid. The drive connection between the money drawer and the lid consists essentially of control levers arranged on the lid which are guided with guide rollers arranged on their free ends in control links formed on the money drawer. The control links are open on one side, so that only the opening motion of the lid is positively controlled, while the closing motion is done only under the weight of the lid itself when the money drawer is closed; in order to lock the lid in its closed position, the control links are each provided with an undercut which secures the guide rollers against lifting out of the control links when the money drawer is fully closed. Link motions in themselves alone are very expensive components which must be fabricated very precisely. With the use of two control links operating parallel according to the German Pat. No. 3,014,545 a very precise mutual adjustment of the two control links and of the control lever is necessary in addition. A further disadvantage of the known solution is seen in the fact that the hinged lid is not positively locked at the same time as the money drawer. If the hinged lid does not reach its closed position by means of its own weight, due for example to bills protruding up over the upper edge of the cashbox, then it remains unclosed even when the cash drawer is locked, since the guide rollers of the lid control lever are not held fast by the undercuts of the control links.

It has also proven that it is advantageous for ergonomic reasons for the cashbox be closable by pressing down the lid and not only by pushing in the money drawer. In the known solution the operative connection between money drawer and lid works in only one working direction, that is, the movement of the lid is controllable by the movement of the cash drawer and not vice versa.

SUMMARY OF THE INVENTION

Therefore it is the problem of this invention to create a cashbox of the type of the species with a substantially improved operational connection of the lid with the money drawer, which thereby permits an ergonomically favorable manipulation and a reliable operation at the same time.

This task is solved according to the innovation by having a least one toothed segment provided which is mounted fixed in the cash case and is pivoted around the lid pivot of the lid, which segment respectively engages with a rack placed on the money drawer, and in that the lid is firmly joined with the toothed segments.

In this cashbox according to the innovation, both the opening and the closing motion of the lid are positively controlled in the moving out and in of the money drawer, since the toothed segments on the one hand are coupled with the money drawer by way of the rack and on the other hand is joined directly to the lid. The positive coupling of the lid with the money drawer in both working directions enables the cashbox to be closed both by sliding in the money drawer and by pushing down the lid. Thus an ergonomically favorable manipulation of the cashbox is ensured.

By reason of the positive coupling of the lid with the cash drawer, a secure locking of the lid is ensured when the cash drawer is closed, i.e., it cannot happen that the money drawer is locked but the lid remains unlocked.

The positive coupling of the lid with the money drawer also has the advantage that no special opening and closing mechanism for the lid is required, which contributes to a simpler and thus more economical fabrication of the cashbox.

What contributes further to the cost reduction is that with this cashbox according to the innovation a comparatively simple sliding drive for the money drawer can be used, which moreover can be accommodated outside the latter in the cash case, so that the usable inner space in the cash drawer itself is fully available.

If the surface of the lid substantially runs through the axis of rotation of the toothed segment, then the lid executes only a simple folding-over or closing motion. This simple motion is particularly favorable for closing the cashbox by pressing down the lid.

With wide money drawers of small depth there is generally a problem that in opening and closing they tilt slightly and thus their reliable and easy manipulability is not ensured. This tilting problem is solved according to this innovation by having a rack arranged on the outside of each side wall of the money drawer each of which racks interacts with a toothed segment arranged in a lateral edge region of the lid. Such a cashbox according to the innovation enables the total inner space of the money drawer to be utilized, since it is not partially blocked up by a spindle or a spring arrangement as in the solution known from German Pat. No. 3,014,545.

If the toothed segment and rack are respectively provided with a non-self-locking gearing, then the money drawer can be moved out or slid in with ease and without any tendency to blocking, even without lubrication.

It is advantageous for the respective toothed segment to be made in the shape of a circular sector, where the angle of the circular sector substantially corresponds to the opening angle of the lid. This has the advantage that the respective toothed segment need be made only as large as is actually necessary for its operation. In this design for an ordinary opening angle for the lid of less than 90°, for example, it can be managed that the toothed segment remains entirely inside the cash case even with the lid fully open, which is advantageous both with regard to possible mishaps and also for aesthetic reasons.

It is advantageous for the spring means of the sliding drive for the money drawer to act on at least one toothed segment and load this in a rotation direction corresponding to the moving-out direction of the money drawer. The rotational motion of the toothed segment is thus usable both for the folding-over motion of the lid and for the sliding drive of the money drawer, since the toothed segment during its rotation operates on the one hand the lid which is directly connected with this and on the other hand operates the money drawer by way of the rack which engages with it. Since the toothed segment here makes only one revolution corresponding to the opening angle of the lid, a simple and thus inexpensive driving spring can be used for the sliding drive of the money drawer. This further development according to the invention is further characterized by only very few moving parts, since both the driving connection of the lid with the money drawer and the sliding drive of the money drawer are operated essentially by a single component, namely the toothed segment.

Both the money drawer and the lid are loaded in a direction corresponding to the opening direction of the money drawer or the lid by a spring element acting on the respective toothed segment eccentrically to the axis of rotation and supported in the cash case. The spring arrangement can be accommodated outside of the money drawer in the rear part of the cash case, so that the usable inner space of the money drawer itself is wholly available.

The respective spring element for this may be made as a pressure spring which respectively acts on a thrust bolt which is pivoted on the cash case.

In a further development of this innovation, the spring means of the sliding drive of the money drawer act on an ejection lever which is operationally connected with the money drawer and load this lever in a swinging direction corresponding to the moving-out direction of the money drawer.

A preferred embodiment of this sliding drive is further characterized in that the ejection lever is pivoted on the bottom of the cashbox on a pivot, in that it is swingable under the money drawer in a plane parallel to the money drawer and in that the spring means act on the ejection lever on the one hand and act on the cashbox bottom on the other hand. This embodiment of the sliding drive has the advantage that it can be accommodated under the money drawer with a saving of space and moreover is simple and therefore economical to fabricate and to mount in the cash case.

The spring means here can be formed by one or more tension springs connected in parallel. For the moving out of a particularly heavy money drawer it is thus easily possible to insert a plurality of similar parallel tension springs by means of a spring suspension plate and thereby increase the spring force for moving out the money drawer.

In a further advantageous embodiment of this sliding drive for the money drawer, the free end of the ejection lever is made in the form of a cam which interacts with a roller pivoted on the money drawer in such a way that the force for moving out the money drawer decreases substantially continuously with a decreasing moving-out path of the latter. Accordingly the full energy stored in the spring means in the moving-out direction then acts on the moving-in monwy drawer. Shortly before the end of the moving-out path of the money drawer, the spring force acts obliquely to the moving-out direction of the money drawer on the roller pivoted on the latter, so that the effective component of force acting in the moving-out direction of the money drawer is smaller. Through this design of the ejection lever the money drawer is highly accelerated at the start of its moving-out path, in order to move out gently and without any hard impact against a moving-out path limit means.

If the money drawer is for example guided on telescopic rails arranged on both sides of it and with roller bearing support, then this has the advantage that thereby the money drawer can be opened and closed with extraordinarily easy action, and besides this, additional protection against tilting of the money drawer is ensured.

The locking mechanism provided for the money drawer in its moved-in position in a preferred embodiment is a locking bolt projecting downward approximately at a right angle on the under side of the money drawer's bottom which bolt can be caught in a retaining prong which is swingable between an unlocking position and a locking position in a swinging plane containing the sliding-in direction of the money drawer and captures the locking bolt, where means are provided for locking the retaining prong in its locking position. This construction makes possible a simple manipulation. The money drawer is pushed into its closed position by pushing it in or by swinging the lid shut against the force of springs acting on it by way of the toothed segment or segments or by way of the ejection lever, where the locking bolt engages in the retaining prong and swings this into its locking position in the last phase of the closing movement. No additional actuation of the locking means is required. For opening the money drawer the locking means are released, for example, by pressing certain keys on the cash register, so that they unblock the retaining prong and the money drawer is moved out by the force of springs acting on it by way of the toothed segments or the ejection lever, and therewith the lid opens at the same time.

The locking unit can be constructed very flat, so that it can be accommodated entirely under the money drawer on a space-saving way, as will be explained further below in more detail. Such a locking of the money drawer represents a simple construction and in particular one secure in operation.

The innovation is explained in the following on the basis of two embodiment examples.

BRIEF DESCRIPTION THE DRAWINGS

DETAILED DESCRIPTION OF THE PREFERRED EMBODIMENTS

Figure 1:
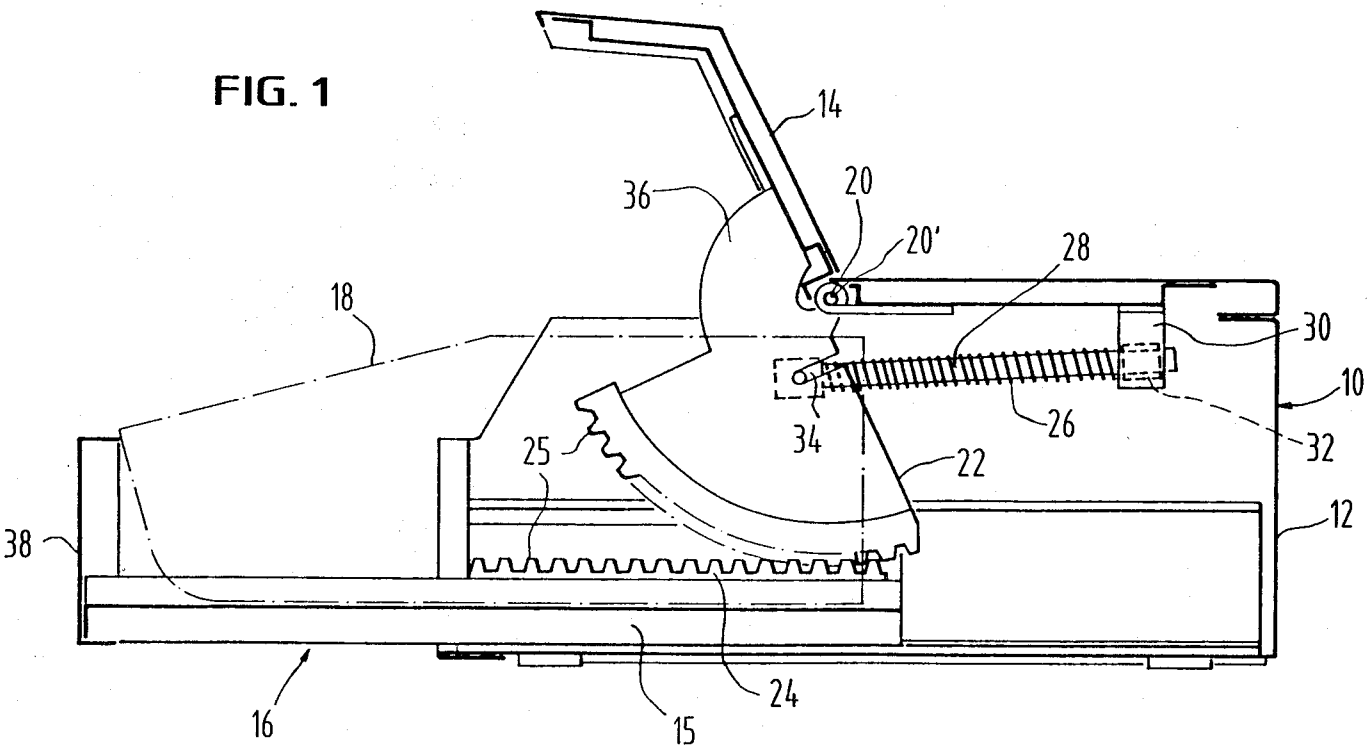
FIG. 1 shows a sectional side view of a cashbox for cash registers with a first embodiment of a money drawer sliding drive with the money drawer moved out and the lip open.

The cashbox 10 for a cash register consists substantially of a cash case 12 with a lid 14 and a money drawer 16 in which a cash insert 18 is inserted. The cash case 12 of the cashbox 10 is for example fabricated from bent sheet metal pieces. The case case 12 is constructed comparatively broad relative to its depth. It is provided with a lid 14 which is hinged on a lid pivot 20 arranged transversely to the sliding-in direction of the money drawer 16 so as to be able to be swung open. The lid pivot 20 is arranged in such a way that when the lid 14 is opened, about half of the horizontal projection of the cash case 12 is visible. The lid 14 is firmly joined with the lid pivot 20 and with two toothed segments 22 (only one of them represented). The two toothed segments 22 each arranged in a lateral edge region of the lid 14 are in engagement with two racks 24 mounted on either side wall 15 of the money drawer (only one being visible) by way of a nonself-locking gearing 25. Two thrust bolts 28 (only one of them represented) which are loaded by pressure springs 26 act on the two toothed segments 22 eccentrically to the axis of rotation. For this the pressure springs 26 are supported against two blocks 30 (only one of them represented) which are fastened onto the cash case 12. The thrust bolt guide 32 is fastened rotatably onto the block 30, and also the thrust bolt 28 at its side turned toward the toothed segment 22 is rotatably hinged on the toothed segment 22. The toothed segment 22 is provided with a slot 34 so that the thrust bolts 28 can be moved in or out. The two toothed segments 22 have essentially the shape of circular sectors, where the angle of a circular sector substantially corresponds to the opening angle of the lid 14. Its pivot 20' is identical with the lid pivot 20 of the lid 14. The lid 14 is firmly joined with the toothed segments 22 by means of reinforcing arms 36. It is evident that the thrust bolts 28 loaded by pressure springs 26 are under initial stress when the lid 14 or the drawer 16 is closed, so that when the cashbox 10 is opened the lid 14 and the money drawer 16 are automatically opened and moved out by spring force. The money drawer 16 is guided on its two drawer side walls 15 by telescopic rails 50 (FIG. 3) in the cash case 12 which can be slid into one another on ball bearings. This together with the two toothed segments 22 which are connected together by way of the pivot or hinge pivot 20,20' and the lid 14 makes it possible for the money drawer 16 to be moved in and out without tilting. This is ensured even when the length or the depth of the money drawer 16 is very small in comparison with its width. This drawer guide also mades it possible for the money drawer 16 to be able to be moved in by simply pressing down the lid 14. The money drawer 16 can also be slid in with no problem and without tilting even when the sliding-in force acts on only one side offcenter. The opening path of the money drawer 16 contributes only about half the depth of the whole money drawer 16. Thus, when the money drawer 16 has moved completely out, this then protrudes out about halfway out of the cash case 12. Access to the other half is unblocked by the opening of the lid 14. By having the cash drawer 16 moved out only up to about halfway, the racks 24 mounted on its two cash drawer side walls 15 still remain wholly in the cash case 12 even when the money drawer 16 is fully moved out. The gearing 25 of both the racks 24 and the toothed segments 22 is made non-self-locking. This enables both the lid 14 and the money drawer 16 to be able to be closed or slid in with only a very slight use of force. The money drawer 16 is provided with a front plate 38 which in the slide-in state of the money drawer 16 forms the front wall of the cash case 10. The cash insert 18, denoted in dot-dash lines in FIG. 1, is located in the money drawer 16. This insert is provided in a known manner with compartments of different sizes for coins and bills. This cash insert 18 is not firmly joined with the money drawer 16, so that it can easily be removed by an operating person. The cash insert 18 is made so that it protrudes out several millimeters above the front plate 38, so that in the closed state of the cashbox 10 the gap between the upper edge of the front plate 38 and the lower front edge of the lid 14 is covered by the front wall of the cash insert 18. Thus, no bills can be pulled out.

Figure 2:
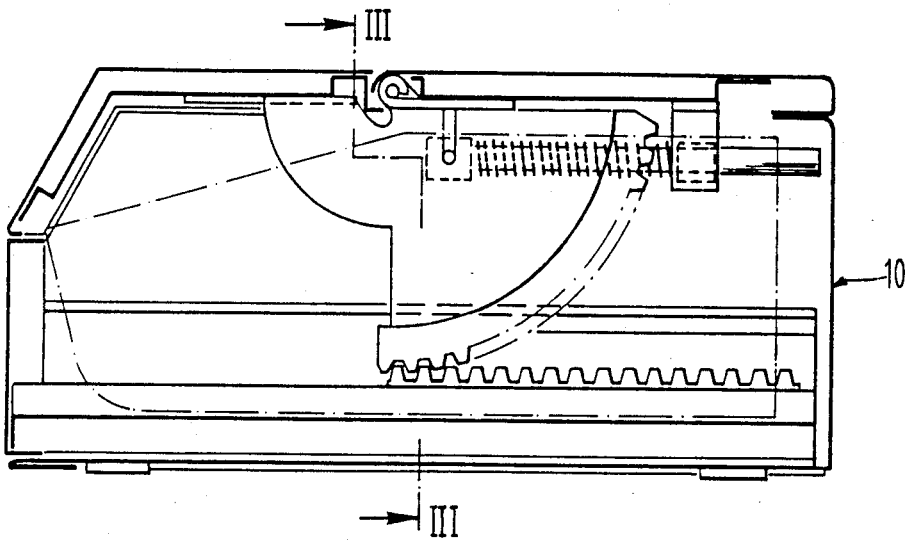
FIG. 2 shows a sectional side view of the same cashbox in the closed state.

FIG. 2 shows the cashbox 10 of FIG. 1 likewise in a lateral sectional view, but this time in the closed state. The cashbox 10 is provided with a locking mechanism (not represented) which holds the money drawer 16 fast in the cash case 12 against the spring force. As a result of the tilt-free guiding of the money drawer the locking mechanism for the money drawer can be simple in design. The locking mechanism can be assigned to any position on the money drawer 16, since the money drawer guiding is made tilt-free.

Figure 3:
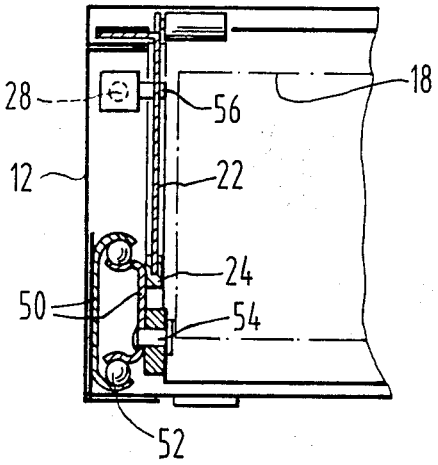
FIG. 3 shows a segment of the section III—III of FIG. 2.

FIG. 3 represents a segment of the section III—III of FIG. 2. The telescopic rails 50 are to be seen which, mounted on balls 52, can be slid one into another. The left half in FIG. 3 of the telescopic rail 50 is fastened onto the cash case 12. The right half in FIG. 3 of the telescopic track 50 is riveted onto the money drawer 16 with rivets 54. One of the two racks 24 is to be seen a section 24. A toothed segment 22 engages in this. A bolt 56 engages in the slot 34 (FIG. 1) of the toothed segment 22 which bolt is mounted projecting transversely to the end of the thrust bolt 28 turned toward the toothed segment 22. The thrust bolt 28 acted on by the pressure spring 26 (FIG. 1) is designated as 28. The cash insert 18 is denoted by dot-dash lines.

Figure 4:
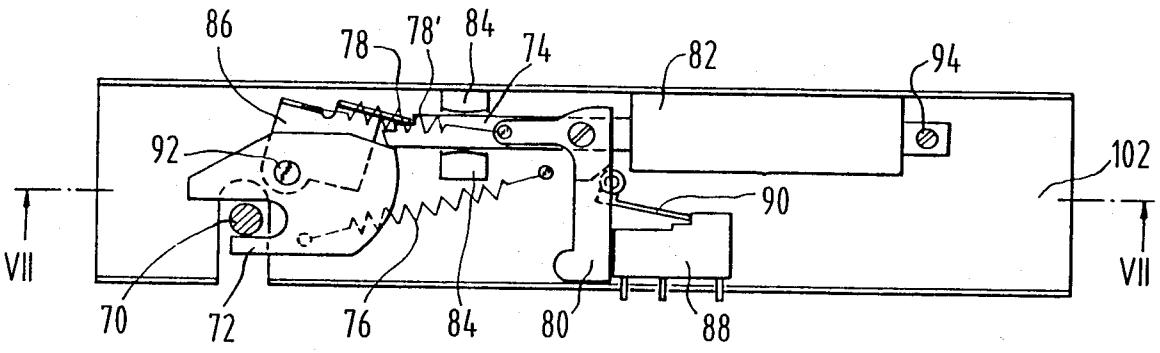
FIG. 4 shows a top plan view of the locking arrangement in the locked position.

FIG. 4 shows a top plan view of the locking arrangement in its locking position. A locking bolt 70 projecting approximately perpendicularly downward is provided on the under side of the money drawer's bottom in a rear position, which bolt can be locked in a retaining prong 72 catching the locking bolt 70. The retaining prong 72 is arranged to be swingable between an unlocking position and a locking position in a swinging plane containing the sliding-in direction of the money drawer 16. A bolt 74 is provided for locking the retaining prong 72 in its locking position. In its closed position the bolt 74 protrudes into the swinging path of the retaining prong 72 and thus blocks its swinging into the unlocking position. In its opening position the slidable bolt 74 unblocks the swinging of the retaining prong 72 into its unlocking position. In the opening position of the slidable bolt 74, the retaining prong 72 is swung by a tension spring 76 into its unlocking position. A first spring 78 acts on the bolt 74, loading this in the closing position, and so does a control mechanism moving this into the opening direction against the force of the spring. This control mechanism includes a manually operable lever 80 and also an electromagnet 82. The slidable bolt 74 is guided in a slide bearing 84. The operation of the bolt 74 by the electromagnet 82 requires a latch 86 which swing between a blocking position holding one of the bolts 74 in its opening position and a free position unblocking this, around the pivot of the retaining prong 72. A second spring 78' acts on the latch 86, loading this in the blocking direction. Preferably this second spring 78' is identical with the first spring 78 which loads the bolt 74 in its closing direction. The catch 86 in its blocking position holds the slidable bolt 74 in its opening position, so that the electromagnet need not be continuously supplied with current during the operation of swinging the retaining prong 72 into its unlocking position. For unlocking the money drawer 16 by means of the electromagnet 82, the latter need only pull the bolt briefly as with an impulse into its opening position. In addition to the electromagnet 82 a manually operable lever 80 is provided for operating the bolt 74. A microswitch 88 is operationally connected with the lever 80 by way of a circuit part 90. The whole control arrangement is built on a base plate 102 which is mounted on the bottom plate 103 of the cash case 12, where both the retaining prong 72 and the latch 86 are swingably pivoted around the bolt 92 and the electromagnet 82 is screwed onto this base plate 102 with a screw 94.

Figure 5:
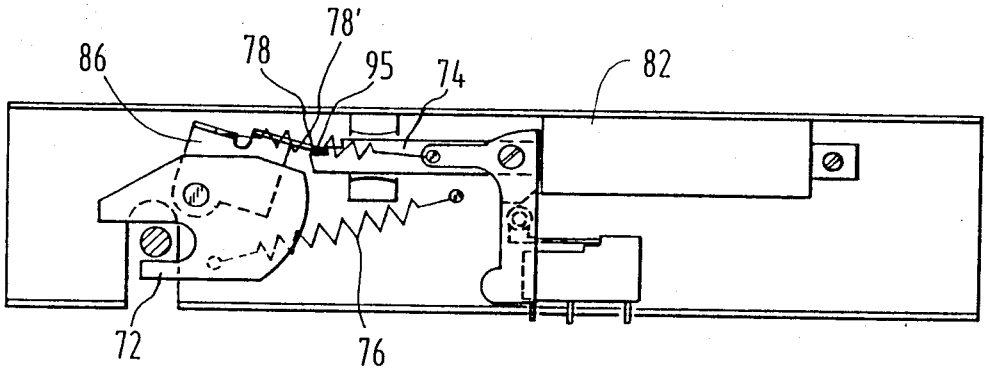
FIG. 5 shows a top plan view of the locking arrangement in the unlocked position.

FIG. 5 shows this locking arrangement in a state where the bolt 74 is in the opening position, the latch 86 is in the blocking position and the retaining prong 72 is still in the locking position. If the slidable bolt 74 is pulled by the electromagnet 82 into its opening position against the spring force of the first spring 78 which loads the bolt 74 in the direction of its closed position, then the latch 86, loaded in its blocking position by the second spring 78' identical with the first spring 78, catches in a recess 95 of the bolt 74. The latter is thereby held in its opening position against the spring force of the first spring 78 even when the electromagnet 82 is no longer active. The retaining prong 72 can now be swung from its locking position into its unlocking position by the tensile force of the tensile spring 76.

Figure 6:
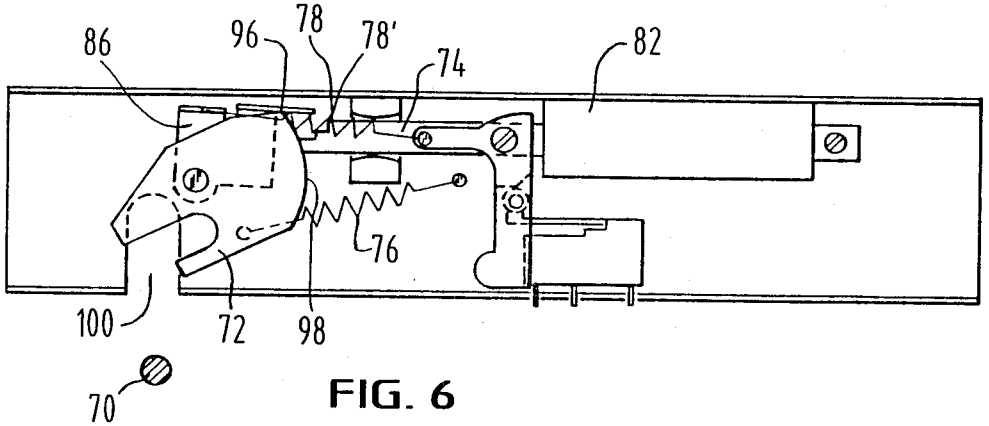
FIG. 6 shows another top plan view of the locking arrangement in the swinging position.

This is represented in FIG. 6. The retaining prong 72 is provided with a cam 96 which, when the retaining prong 72 swings into its unlocking position, moves the latch 86 into its free position against the force of the second spring 78'. If the latch 86 is moved out of its blocking position into its free position, then the bolt 74 is unblocked thereby. This bolt 74 now comes under the action of the first spring 78 on a contact surface 98 formed on the retaining prong 72 in the swinging positions located outside the locking position of the retaining prong 72. When the retaining prong 72 is swung, the bolt 74 slides along the contact surface 98. At this time the catch 86 is retained in its free position under the action of the cam 96. By having the bolt 74 no longer held by the latch 86 in its opening position, the locking arrangement is activated again, i.e., if the money drawer 16 is pushed in, this is locked by having the bolt 74 pulled into its closing position by the spring force of the first spring 78. The locking arrangement thus reaches its locking position by having the locking bolt 70 slide into a guide recess 100 by the sliding in of the money drawer 16. Through the pressure of the locking bolt 70 on the retaining prong 72 eccentrically to its axis of rotation, the retaining prong 72 is swung into its locking position by the pushing in of the money drawer 16 into its locking position.

Figure 7:
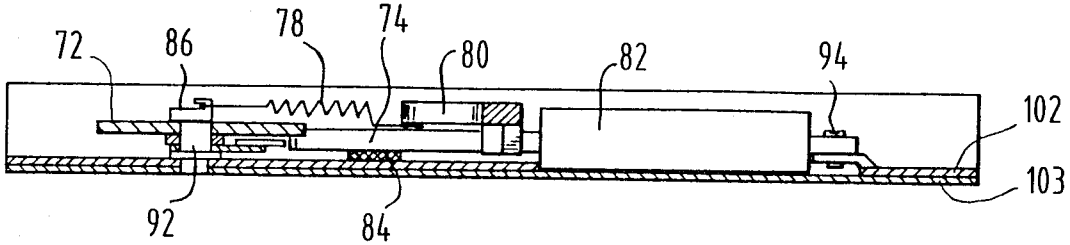
FIG. 7 shows the section VII—VII of FIG. 4.

FIG. 7 shows the section VII—VII of FIG. 4. One may see the retaining prong 72 and the latch 86 both of which are arranged to be pivotable around the bolt 92. Besides this the bolt 74, the lever 80 and the electromagnet 82 are to be seen. The springs 78,78' on the one hand load the latch 86 in the direction of its blocking position and on the other hand load the bolt 74 in its closing position blocking the swinging of the retaining prong 72. The bolt 74 is guided by the slide bearing 84. The locking arrangement may be mechanically controlled by means of the lever 80 as is yet to be explained. The electromagnet 82 is fastened on the base plate 102 with a screw 94.

Figure 8:
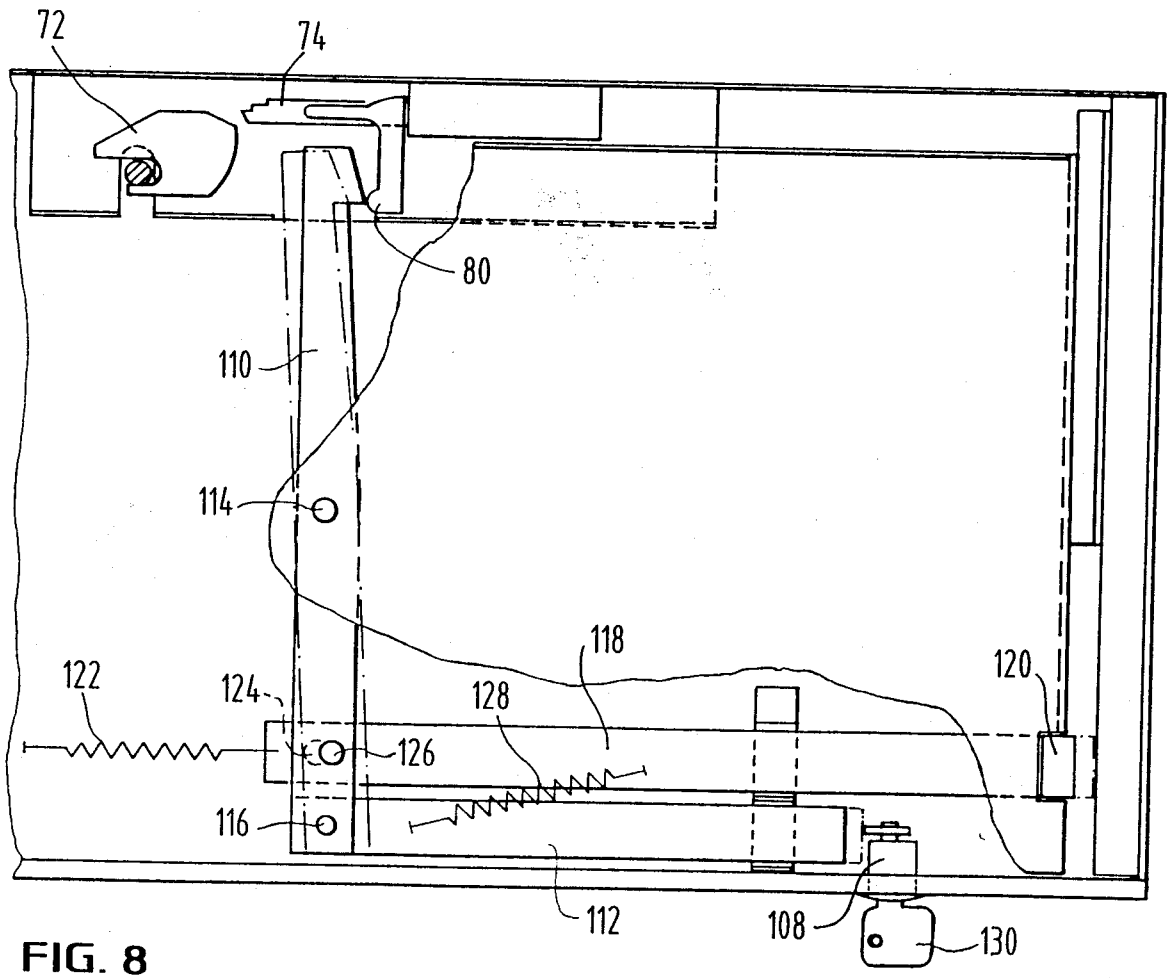
FIG. 8 shows a top plan view of a first embodiment example of the mechanical control mechanism of the locking arrangement.

FIG. 8 shows a first embodiment example of the mechanical control mechanism of the locking arrangement. The bolt 74 can be mechanically brought into its opening position with the aid of a cylinder lock 108 by way of the lever 80, a rocker arm 110 serving as a sliding bolt and a connecting rod 112. The rocker arm 110 is pivoted tiltably on a swing bolt 114 on the under side of the money drawer bottom. While one end of the rocker arm 110 acts on the lever 80, the other end of the rocker arm 110 is joined movably with the connecting rod 112 by way of a pin 116. If the cashbox 10 (FIG. 1) is to be opened by means of a key 130, then the cylinder lock 108 is operated on the front side of the cashbox 10 (FIG. 1). By rotating its closing cylinder mounted eccentrically to the axis of rotation, the connecting rod 112 is pushed to the left in the figure. Thereby the end of the rocker arm 110 connected with the connecting rod 112 is likewise moved to the left. The deflection on the swing bolt 114 causes the end of the rocker arm 110 acting on the lever 80 to be moved to the right in the figure. Thereby the bolt 74 is brought into its opening position and thus the retaining prong 72 is unlocked. This mechanical operating mechanism further includes a night unlocking bolt 118 which in a first active position fixes the rocker arm 110 and thus the lever 80 in its position corresponding to the opening position of the lock 74 and in a second inactive position unblocks this. On the night unlocking bolt 118 is formed a control surface 120 interacting with a wall surface of the cash insert 18 (FIG. 1) through which control surface the night unlocking bolt 118 is pushed into a second inactive position when the cash insert 18 (FIG. 1) is inserted. If the cash insert 18 (FIG. 1) is removed, then the night unlocking bolt 118 is pushed by an opening spring 122 into its first active position. In this first position of the night unlocking bolt 118 the locking arrangement always remains unlocked. Thus it is not possible to lock the cashbox 10 (FIG. 1) when the cash insert 18 (FIG. 1) is removed. If the night unlocking bolt 118 is in its second unactive position when the cash insert 18 (FIG. 1) is inserted, the locking arrangement can nonetheless be unlocked mechanically by means of the cylinder lock 108. This is facilitated by the use of an oblong hole 124 in the night unlocking bolt 118. Thus if the locking arrangement is unlocked by means of the cylinder lock 108 when the cash insert 18 is inserted (FIG. 1), then the pin 126 firmly joined to the rocker arm 110 can be moved along in the oblong hole 124 without being blocked by the night unlocking bolt 118 which is pushed by the inserted cash insert 18 (FIG. 1) into its second inactive position. If the cash insert 18 (FIG. 1) is removed, then, as was already described, the sliding bolt 118 is moved to the left in the figure. Since the pin 126, as is shown in the figure lies against the right side of the oblong hole 124, the night unlocking bolt 118 acts on the rocker arm 110 and thus on the rocker level 110 and thus on the lever 80. The night unlocking bolt 118 and the connecting rod 112 are connected together with a coupling spring 128.

Figure 9:
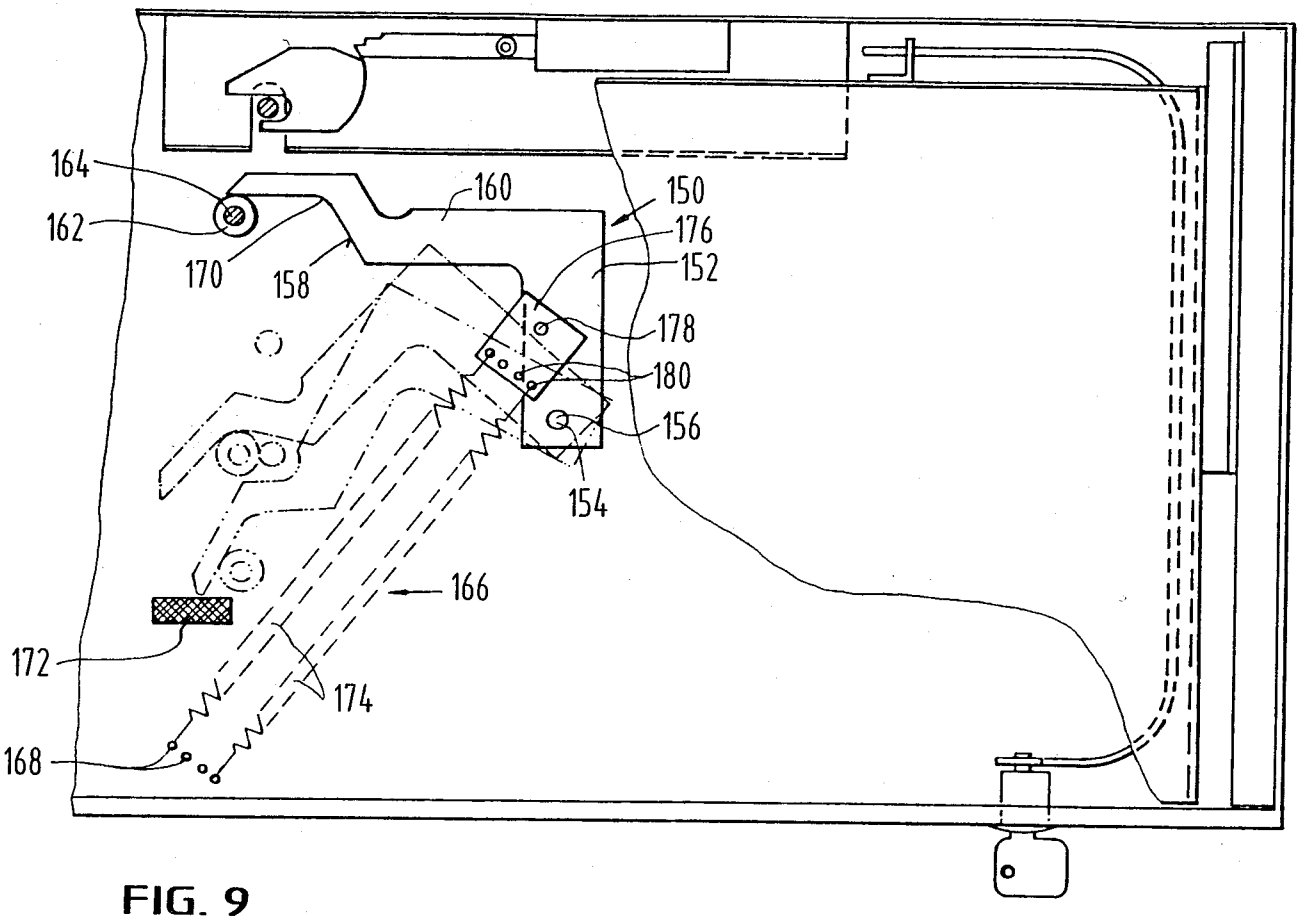
FIG. 9 shows a second embodiment example of the sliding drive of the money drawer.

FIG. 9 shows a second embodiment example of the sliding drive of the money drawer. An ejection lever 150 is to be seen which for example can be fabricated from a sheet metal material. It has essentially the shape of an angle steel piece, the arms 152 and 160 of which are approximately perpendicular to each other. In the first arm 152 of the angle steel piece, near its free end, there is a bearing bore 154 by means of which the ejection lever 150 is pivoted around a pivot pin 156 on the inside of the cashbox bottom. The free end of the second arm 160 of the ejection lever 150 is made as a cam 158 which interacts with a roller 162 pivoted on the under side of the money drawer by means of a pivot pin 164. Approximately in the center of the first arm 152, a spring suspension plate 176 is pivoted on this at a pivot point 178. In the bores 180 of this plate are hung the ends on the lever side of tension springs 174 acting parallel, which together form a tension spring 166. The ends on the case side of the tension springs 174 are anchored onto the cashbox bottom by means of fastening bolts 168. They may also be suspended in bores of another spring suspension plate (not represented) which in turn must be fastened onto the bottom of the cashbox.

When the money drawer is moved in, the ejection lever 150 is then in the position represented. The tension spring element 166 is under initial tension. If the money drawer is unlocked, then the ejection lever 150 swings, driven in a counterclockwise direction around the pivot 156 by the tension spring element 166. Thereby the roller 162 and with it the money drawer is moved in the moving-out direction. The roller 162 rolls along on the cam 158 on the moving-out path of the money drawer. At the start of the moving-out path, at first the full energy stored in the spring element acts in the moving-out direction of the money drawer. After about half of the moving-out path of the money drawer, the roller 162 which is then rolling along on the cam 158 reaches a recess 170 in the cam 158, in which the roller 162 remains for a substantial length of its path (represented by a dot-dash line). On this length portion the force acting in the moving-out direction of the money drawer remains nearly constant. Toward the end of the moving-out path, the direction of action of the driving force acting on the money drawer deviates more and more from the moving-out direction of the money drawer. Thus the component of force acting in the moving-out direction becomes smaller and smaller, and thereby the money drawer moves out gently. The swinging path of the ejection lever 150 is limited on the opening side by an elastic buffer element 172 (represented in a dot-dot-dash line).

Figure 10:
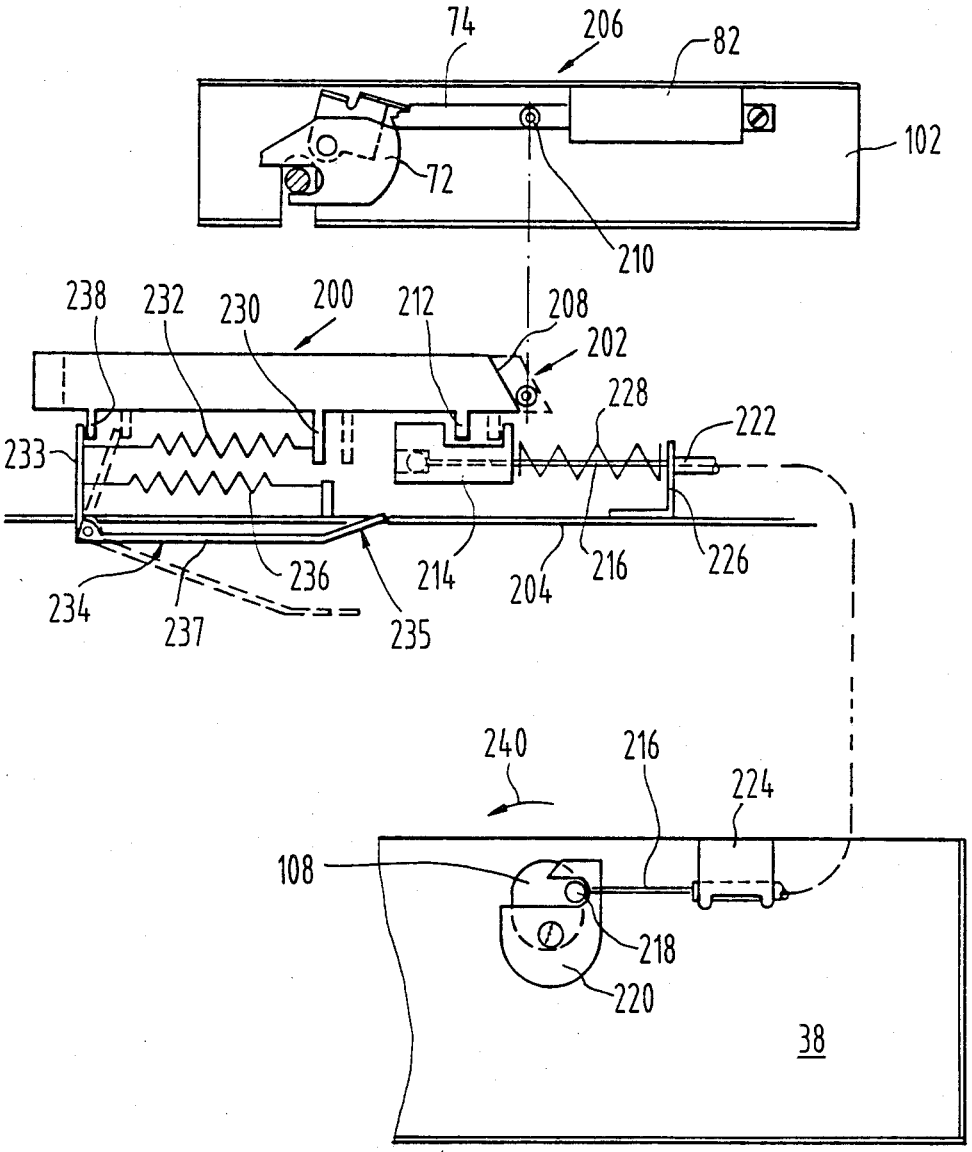
FIG. 10 shows a second embodiment of the mechanical control mechanism of the locking arrangement.

FIG. 10 in a diagrammatic representation shows a second embodiment example of a mechanical control mechanism of the locking arrangement. For a better understanding not at all of the guide elements and points of support for the moving parts are represented. Besides this, all of the parts corresponding in structure to the first embodiment example of FIG. 8 are provided with the same reference numbers. A difference from the embodiment example shown in FIG. 8 here is that the bolt 74 is mechanically brought into its opening position by means of a sliding bolt 200. The sliding bolt 200 is part of a mechanical control mechanism 202. This is arranged on the rear wall 204 of the money drawer above the locking arrangement 206 in such a way that when the drawer is closed the bolt surface 208 of the sliding bolt 200 is operationally connected with this first extension 212 which carrier in turn is coupled with one end of a Bowden control cable core 216. The other end of the Bowden control cable core 216 is hooked by means of a loop or a Bowden control cable clamp 218 with a carrier plate 220. The carrier plate 220 is joined with the closing cylinder of the cylinder lock 108 which is mounted on the front side 38 (represented here only as a fragment) of the money drawer. The Bowden sheet is . . . the sheet metal flaps 224 are held on the front side 38, and by its other end it is supported on a bracing angle piece 226 fastened on the rear wall 204 of the money drawer. The Bowden control cable core 216 is under initial tension by a pressure spring 228 in the rest position of the control mechanism 202. The pressure spring 228 is supported on the one hand on the carrier 214 and on the other hand on the bracing angle piece 226.

An extension 230 is formed in the center on the sliding bolt 200. This extension is joined to one end of a first tension spring 232. The other end of the tension spring 232 is joined with a first arm 233 of a two-armed night unlocking lever 234. The tension spring 232 acts on the sliding bolt 200 with an initial tension in the direction of its rest position.

A second tension spring 236 puts the night unlocking lever 234 under initial tension in the direction of the night unlocking position (represented in broken lines). This tension spring 236 is also connected by its one end with a first arm 233 of the night unlocking lever 234. The second tension spring 236 is anchored by its other end on the rear wall 204 of the money drawer. The first arm 233 of the night unlocking lever 234 is braced on a third extension 238 of the sliding bolt 200.

When the cash insert 18 is inserted in the money drawer (FIG. 1), this insert presses by its rear wall against a control surface 235 of the second arm 236 of the night unlocking lever 234 and holds this in the position shown in solid lines. Therewith the control mechanism 202 is inactive. If the cash insert 18 is taken out of the money drawer, then the night unlocking lever 234, driven by the second tension spring 236, swings into the unlocking position shown in broken lines. Thereby the sliding bolt 200 is brought into its unlocking position (represented by broken lines). If the money drawer is closed, then the bolt surface 208 of the sliding bolt 200 pushes the bolt roller 210 to the right in the figure and the bolt 74 reaches its open position (FIG. 5). Thus it is not possible to lock the cashbox 10 (FIG. 1) with the cash insert 18 removed (FIG. 1).

As has already been stated above, when the cash insert is inserted the cashbox must be able to be opened manually. This is done by operating the cylinder lock 108. That is, if the closing cylinder of the latter is rotated in the direction of the arrow 240, then by means of the Bowden control cable 216 the carrier 214 and thus the sliding bolt 200 are moved into the unlocking position (represented in broken lines), whereby the bolt 74, as already described, becomes unlocked.

All of the above-described features of the innovation may be an essential part of the invention, singly or in any desired combination.

We claim:

1. A cash register, cashbox assembly comprising:

a cash case having opposite parallel first and second side walls and a top, said top being divided between a rearward portion which is fixed to said side walls and a forward lid portion which is pivotally mounted to said rearward portion for rotation about a transverse axis between closed and opened positions;

a cash drawer having opposite parallel side walls, a bottom, a rear wall and an open top;

means for mounting said drawer within said case for fore-and-aft longitudinal displacement between a position wholly within said cash case and a position partly forwardly extended from said cash case;

first and second longitudinally extending racks mounted on opposite lateral side walls of the drawer;

first and second toothed segments of rigid material pivotally displaceably mounted on said first and second side walls, respectively, of the case and having the teeth thereof in engagement with respective racks whereby fore-and-aft displacement of the drawer is accomplished by rotation of said segments;

each said toothed segment having integrally formed therewith a rigid arm which is mechanically connected to said lid portion such that rotation of said segments opens and closes said lid portion relative to said cash case; and bias spring means mechanically connected between said cash case and at least one of said toothed segments to bias said segments toward a position in which said lid portion is closed.

2. An assembly as claimed in claim 1, characterized in that a surface of the lid portion (14) runs substantially through an axis of rotation (20') of the toothed segments (22).

3. An assembly as claimed in claim 1, characterized in that the toothed segments (22) and racks (24) are provided with a non-self-locking gearing (25).

4. An assembly as claimed in claim 1, characterized in that each toothed segment (22) has approximately the shape of a semicircular sector, where the angle of the circular sector substantially corresponds to the opening angle of the lid (14).

5. An assembly as claimed in claim 1, characterized in that the biased spring means (26) acts on at least one of said first and second toothed segments (22) to rotate said one segment in a direction corresponding to the moving-out direction of the money drawer (16).

6. An assembly as claimed in claim 5, characterized in that the spring means (26) is formed by at least one spring element (26) acting eccentrically to the axis of rotation (20') of a toothed segment (22) and supported on the cash case (12).

7. An assembly as claimed in claim 6, characterized in that the spring element (26) is made as a pressure spring.

8. An assembly as claimed in claim 1 further comprising an ejection lever (150) which is operationally connected with the money drawer (16) to load said lever in a swinging direction corresponding to the moving-out direction of the money drawer.

9. An assembly as claimed in claim 8, characterized in that the ejection lever (150) is pivoted on the bottom of the cashbox on a pivot (156), in that it is swingable under the money drawer (16) in a plane parallel to the money drawer bottom and in that the spring means (166) act on the ejection lever (150) on the one hand and act on the cashbox bottom on the other hand.

10. An assembly as claimed in claim 8, characterized in that the spring means (166) is formed by one or more tension springs (174) connected in parallel.

11. An assembly as claimed in claim 8, characterized in that the free end of the ejection lever (150) is made in the form of a cam (158) which interacts with a roller (162) pivoted on the money drawer (16) in such a way that the force for moving out the money drawer (16) decreases substantially continuously with an increasing moving-out path of the latter.

12. An assembly as claimed in claim 1, characterized in that the money drawer (16) is guided on telescopic rails (50).

13. An assembly as claimed in claim 1 further comprising locking means (70) disposed on the drawer and a cooperative locking element (72) disposed on the cash case for operative engagement with the locking means (70).

14. An assembly as claimed in claim 13, wherein the locking means (70) is a locking bolt (70) projecting downward aproximately at a right angle on the under side of the money drawer's bottom, which bolt can be caught in a retaining prong (72) which is swingable between an unlocking position and a locking position in a swinging plane containing the sliding-in direction of the money drawer (16) and captures the locking bolt (70), and in that means are provided for locking the retaining prong (72) in its locking position.

15. An assembly as claimed in claim 14, characterized in that the means for locking the retaining prong (72)

include a bolt (74) slidable between a closing position protruding into the swinging path of the retaining prong (72) and blocking its swinging into the unlocking position and an opening position unblocking this swinging, on which bolt a first spring (78) acts which load this in the closing direction and on which a control mechanism acts which moves the bolt into the opening direction against the force of the spring.

16. An assembly as claimed in claim 15, characterized in that the control mechanism is an electromagnet (82), in that a ratchet (84) is provided which is movable between a blocking position holding the bolt (74) in its open position and a free position unblocking the latter, in that a second spring (78') loading this in the blocking direction acts on the ratchet (86), and in that a cam (96) or the like is formed on the retaining prong (72) which cam moves the ratchet (86) into its unblocking position with the swinging of the retaining prong (72) into its unlocking position against the force of the second spring (78'), and in that on the retaining prong (72) a contact surface (98) is formed against which the bolt (74) comes to lie under the action of the first spring (78) with the swinging positions of the retaining prong (72) outside of the locking position.

17. An assembly as claimed in claim 15, characterized in that the control mechanism includes a sliding bolt (110;200) which can be mechanically operated by a key or the like and slides the bolt (74) into its opening position.

18. An assembly as defined in claim 17 further comprising a cash insert which is smaller than and insertable into said cash between the parallel side walls thereof, a bar mounted in said cash case for displacement between first and second positions and extending into operative association with said bolt for holding said bolt in an unlatched position when said bar is in a first position and for releasing said bolt when said bar is in a second position, and means responsive to the disposition of said insert in said cash box for holding said bar in said second position.

* * * * *